US009366078B2

(12) United States Patent
Choi et al.

(10) Patent No.: US 9,366,078 B2
(45) Date of Patent: Jun. 14, 2016

(54) PROTECTION DEVICE FOR BLIND STRING

(71) Applicants: Yeon Seok Choi, Gyeonggi-do (KR); Sung Hee Han, Daejeon (KR); Doo Jin Kim, Seoul (KR)

(72) Inventors: Yeon Seok Choi, Gyeonggi-do (KR); Sung Hee Han, Daejeon (KR); Doo Jin Kim, Seoul (KR)

( * ) Notice: Subject to any disclaimer, the term of this patent is extended or adjusted under 35 U.S.C. 154(b) by 9 days.

(21) Appl. No.: 14/245,137

(22) Filed: Apr. 4, 2014

(65) Prior Publication Data

US 2015/0247361 A1 Sep. 3, 2015

(30) Foreign Application Priority Data

Mar. 3, 2014 (KR) ..... 10-2014-0024897

(51) Int. Cl.
*E06B 9/28* (2006.01)
*E06B 9/326* (2006.01)

(52) U.S. Cl.
CPC ..... *E06B 9/326* (2013.01); *Y10T 24/3904* (2015.01)

(58) Field of Classification Search
CPC ..... E06B 9/322; E06B 9/324; E06B 9/326; E06B 2009/3222
USPC ..... 160/178.1 R, 178.2
See application file for complete search history.

(56) References Cited

U.S. PATENT DOCUMENTS

| | | | | |
|---|---|---|---|---|
| 3,597,517 | A * | 8/1971 | Smith | 264/506 |
| 5,613,540 | A * | 3/1997 | Jelic | 160/84.04 |
| 5,722,478 | A * | 3/1998 | Claypool et al. | 160/173 R |
| 6,792,995 | B2 * | 9/2004 | Judkins | 160/84.04 |
| 7,174,943 | B2 * | 2/2007 | Wang | 160/178.2 |
| 7,793,700 | B2 * | 9/2010 | Bossler | 160/173 R |
| 8,931,539 | B1 * | 1/2015 | Jaggli | 160/168.1 R |
| 2003/0201076 | A1 * | 10/2003 | Nien | 160/168.1 R |
| 2010/0181409 | A1 * | 7/2010 | Chen | 242/376 |

FOREIGN PATENT DOCUMENTS

KR 10-2011-0106249 A 9/2011

* cited by examiner

*Primary Examiner* — Katherine Mitchell
*Assistant Examiner* — Abe Massad
(74) *Attorney, Agent, or Firm* — Rabin & Berdo, P.C.

(57) ABSTRACT

Disclosed is a protection device for a blind string. The protection device includes a bellows tube provided in a tubular structure, allowing the blind string to pass through an inner part thereof, and having a length increased or reduced in a longitudinal direction of the blind string, a first module coupled with a lower end portion of the bellows tube and having an inner part to which an end portion of the blind string is locked, and a second module decoupled from the first module at an upper portion of the first module while the bellows tube is interposed between the first module and the second module, such that the bellows tube is folded. The bellows tube has a difference in the thickness of the skin thereof such that the bellows tube is automatically spread due to elasticity thereof when the second module is moved up from the first module.

11 Claims, 11 Drawing Sheets

PROTECTION DEVICE FOR BLIND STRING

BACKGROUND OF THE INVENTION

1) Field of the invention

The present invention relates to a protection device for a blind string. In more detail, the present invention relates to a protection device for a blind string, capable of safely protecting children from a blind string so that the children are not in an accident caused by the blind string, and capable of being operated in a compact and effective structure so that the convenience for the use of the protection device can be increased.

2) Background of Related Art

In Korea, although there are no statistics of accidents related to blind strings, accidents, in which children have necks tightened by a blind string in the middle of playing with the blind string after going up sofas or desks, have been frequently announced.

For this reason, Korean Agency for Technology and Standards (KATS) has announced a safety standard that a blind is disassembled if a predetermined load is applied to the blind string so that children are not tightened by the blind string.

In detail, the KATS recently introduced a preliminary announcement on legislation, "the Quality Management and Safety Control of Industrial Products ACT", to designate a blind as one of safety management items, and planned to make a safety standard of a blind string.

Therefore, from the first half of 2012, in a blind sold in the market, a string is separated from a body of the blind if a weight exceeding a reference value is applied to the string, a part to keep the string out of hands of children is mounted, or an additional protection device must be mounted.

In order to meet the above situation, the present applicant has previously applied a protection device for a blind string, which can safely protect children from the blind string so that the children are not in an accident caused by the blind string, as a patent application (Korean Patent Application No. 10-2011-0080426), and suggests an advanced protection device for a blind string in the present invention.

SUMMARY OF THE INVENTION

An object of the present invention is to provide a protection device for a blind string, capable of safely protecting children from a blind string so that the children are not in an accident caused by the blind string, and capable of being operated in a compact and effective structure so that the convenience for the use of the protection device can be increased.

In order to accomplish the above object, there is provided a protection device for a blind string. The protection device includes a bellows tube provided in a tubular structure, allowing the blind string to pass through an inner part thereof, and having a length increased or reduced in a longitudinal direction of the blind string, a first module coupled with a lower end portion of the bellows tube and having an inner part to which an end portion of the blind string is locked, and a second module decoupled from the first module at an upper portion of the first module while the bellows tube is interposed between the first module and the second module, such that the bellows tube is folded. The bellows tube has a difference in the thickness of the skin thereof such that the bellows tube is automatically spread due to elasticity thereof when the second module is moved up from the first module.

One of the first and second modules may have a locking hook, and a remaining one of the first and second modules may have a locking step to which the locking hook is locked.

The locking hook may be provided at the first module, and the locking step may be provided at the second module.

The first module may include an outer cap for a lower part of the first module, inner caps for first and second lower modules partially inserted into the outer cap for the lower module, prepared separately from each other, and detachably coupled with each other, and a string locking member detachably coupled with the inner cap for the first lower module such that the blind string is locked to the string locking member.

The inner cap of the first module may be provided in an inner wall thereof with a rail coupling groove with which a rail block of the string locking member is slidably coupled.

The second module may include first and second housings to form a space through which the blind string passes and detachably coupled with each other, a fixed gear having both end portions rotatably coupled with inner walls of the first and second housings, a movable gear arranged adjacent to the fixed gear while the blind string is interposed between the movable gear and the fixed gear to approach the fixed gear or be spaced apart from the fixed gear, and a lever having one side provided in the first and second housings and an opposite side out of the first and second housings and allowing the movable gear to approach the fixed gear such that the blind string is clamped between the fixed gear and the movable gear.

The protection device may further include movement guide walls provided at the inner walls of the first and second housings to guide position change of the movable gear.

The protection device may further include rotation guide tooth parts provided at the inner walls of the first and second housings to guide rotation of the movable gear.

The lever may include a hinge coupled with the first and second housings, a gear pressing plate coupled with the hinge, having an opening, through which the blind string passes, and pressing the movable gear, and a manipulation part coupled with the gear pressing plate and provided outside the first and second housings.

The protection device may further include a waveform step part formed in the first and second housings corresponding to a position of the manipulation part to guide position change of the manipulation part step by step. The manipulation part may be additionally coupled with a protrusion plate having a protrusion part locked to the waveform step part.

The fixed gear may have a diameter greater than a diameter of the movable gear.

The protection device may further include a partition formed at the inner walls of the first and second housings and having an opening through which the blind string passes.

The blind sting may include only a string or comprises a beaded string, and the blind string may be completely hidden in the bellows tube so that the blind string is not viewed outside when the bellows tube is spread due to elasticity thereof so that the second module is moved up from the first module As described above, according to the present invention, the protection device for the blind string can be provided to safely protect children from a blind string so that the children are not in an accident caused by the blind string, and to be operated in a compact and effective structure so that the convenience for the use of the protection device can be increased.

DETAILED DESCRIPTION OF THE INVENTION

Hereinafter, an exemplary embodiment of the present invention will be described with reference to accompanying drawings.

Figure 1:
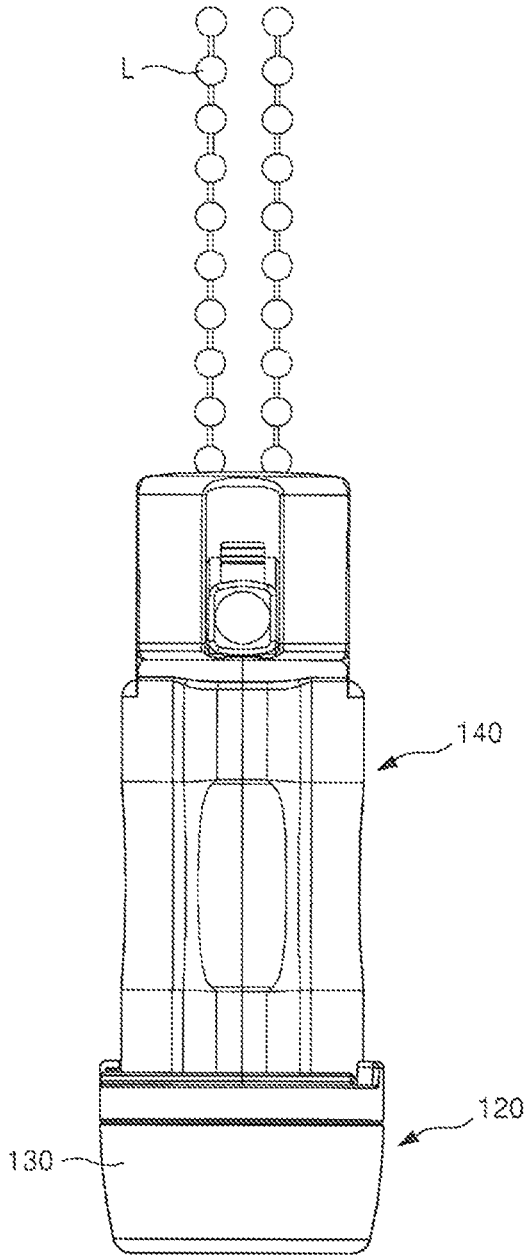
FIG. 1 is a front view showing a protection device for a blind string according to one embodiment of the present invention before the protection device is operated.
Figure 2:
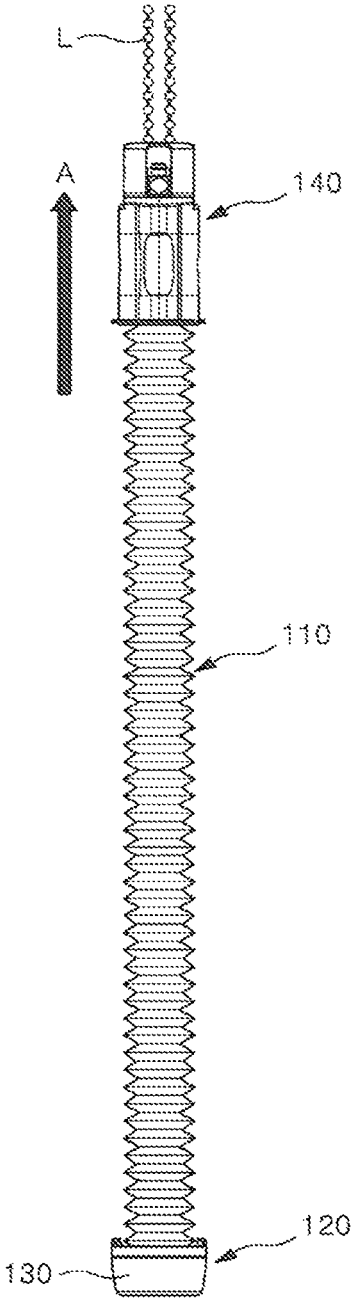
FIG. 2 is a front view showing the protection device of FIG. 1 after the protection device has been operated.
Figure 3:
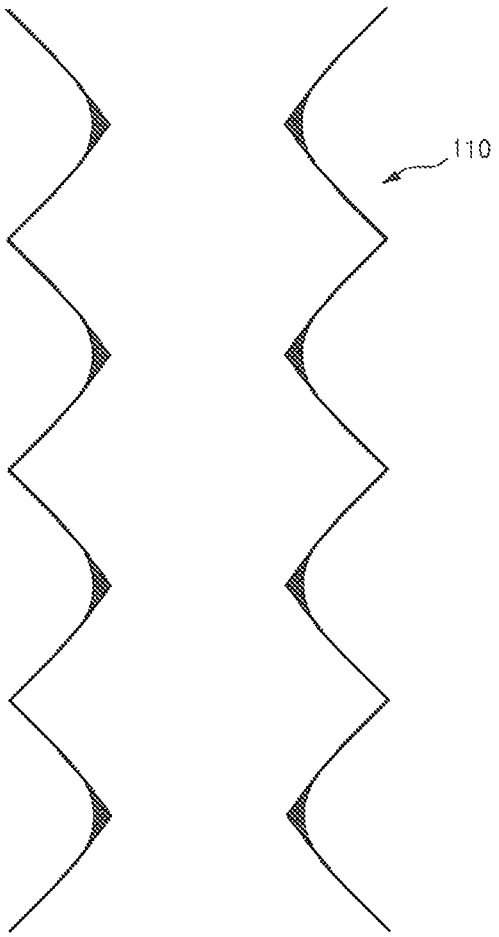
FIG. 3 is a view showing the structure of a bellows tube.
Figure 4:
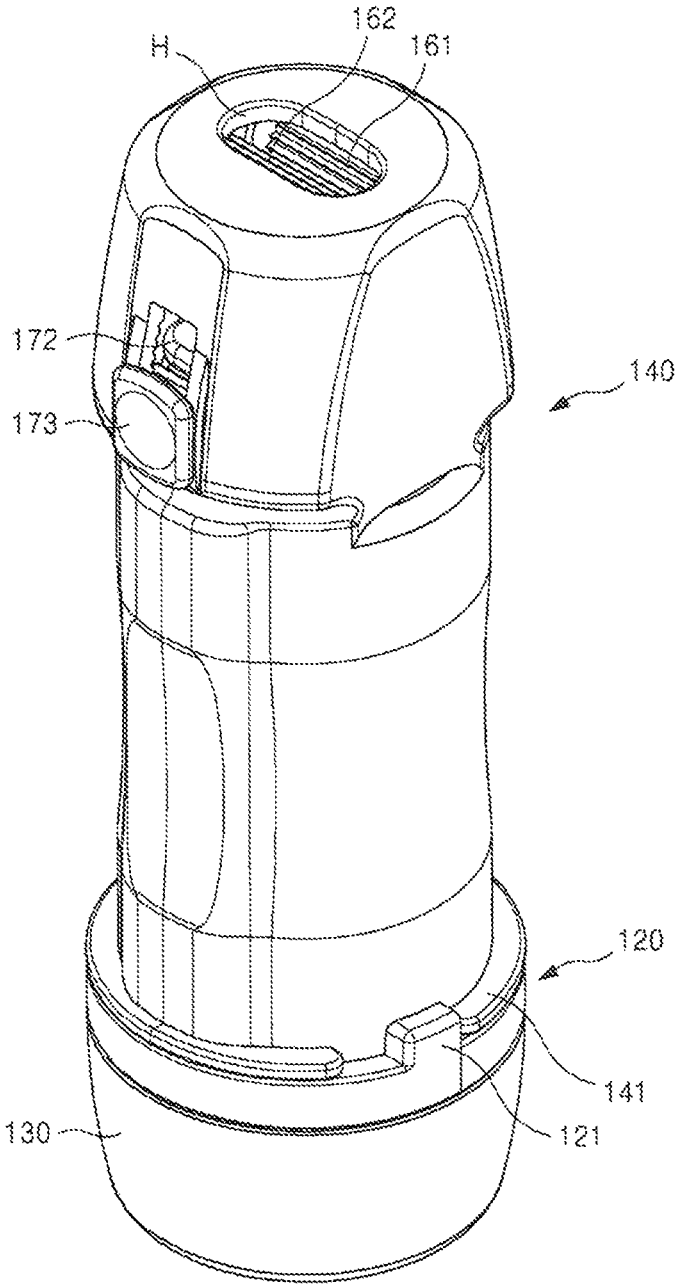
FIG. 4 is a perspective view showing the protection device for the blind string.
Figure 5:
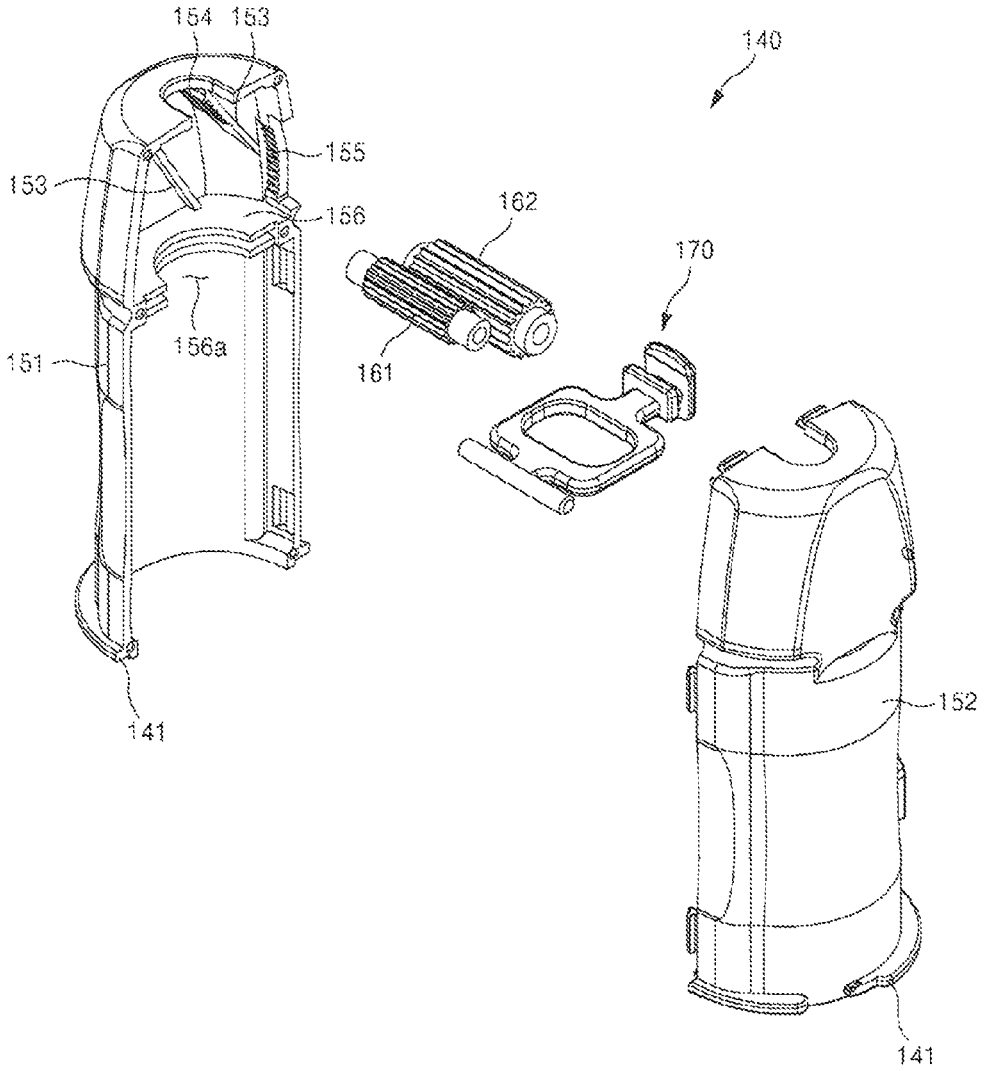
FIGS. 5 to 8 are exploded perspective views showing a second module at various angles.
Figure 6:
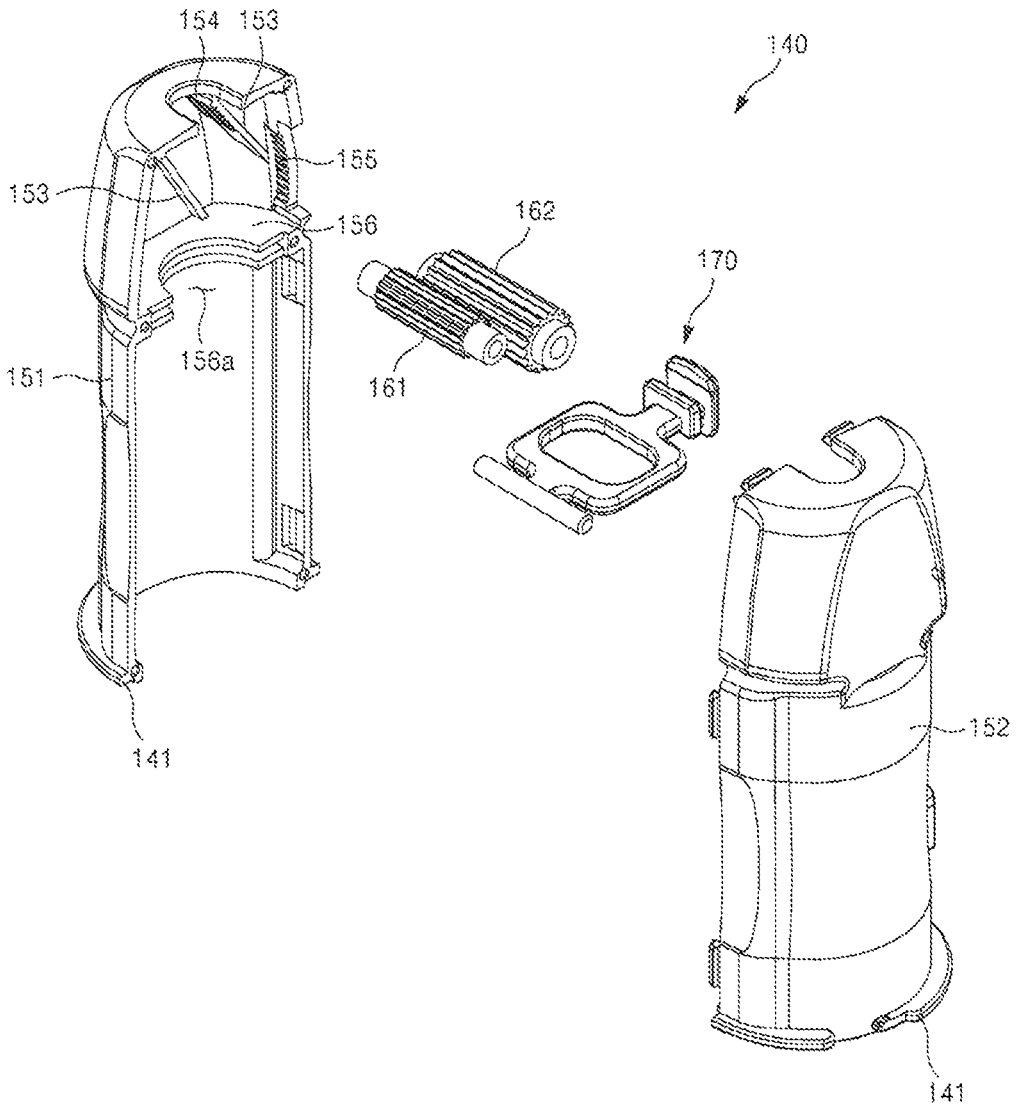
Figure 7:
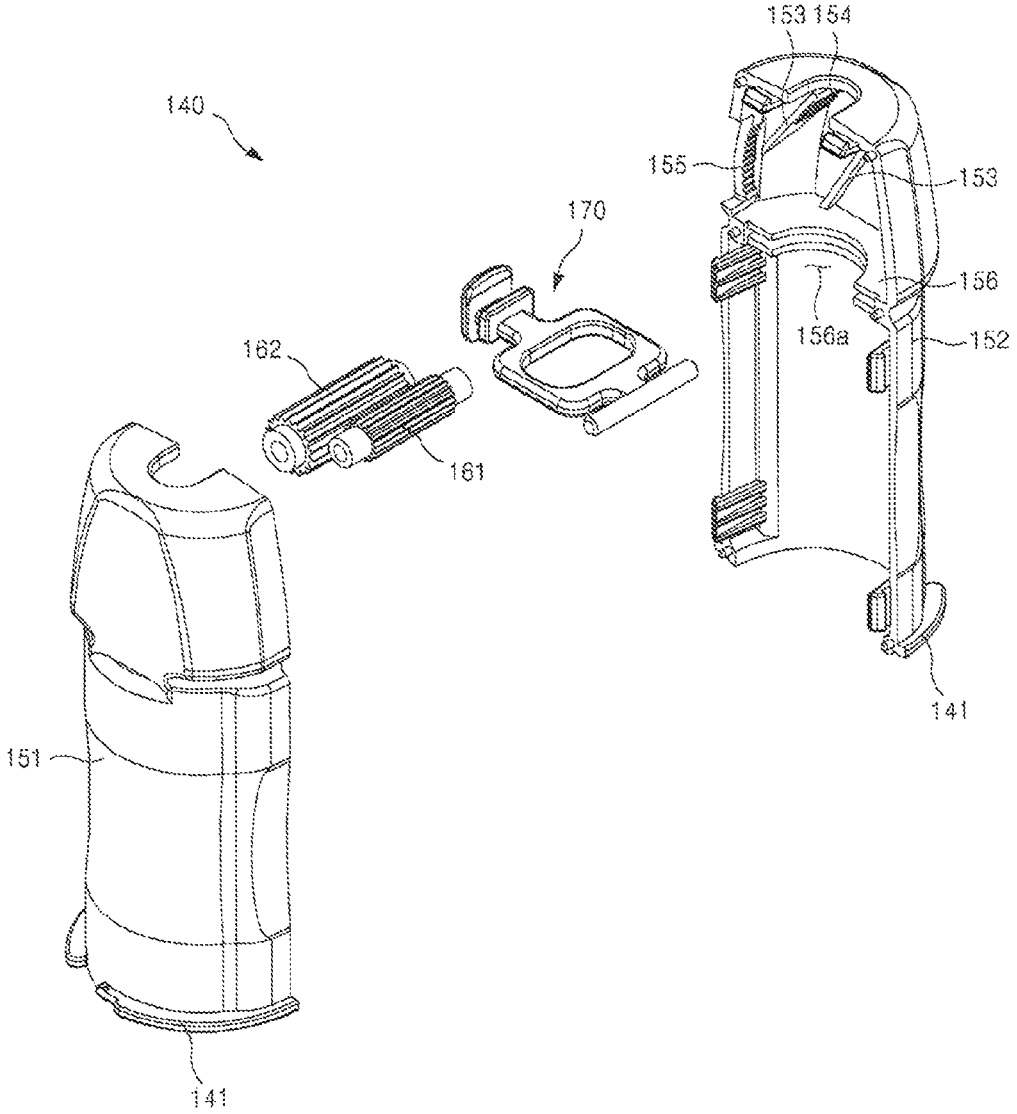
Figure 8:
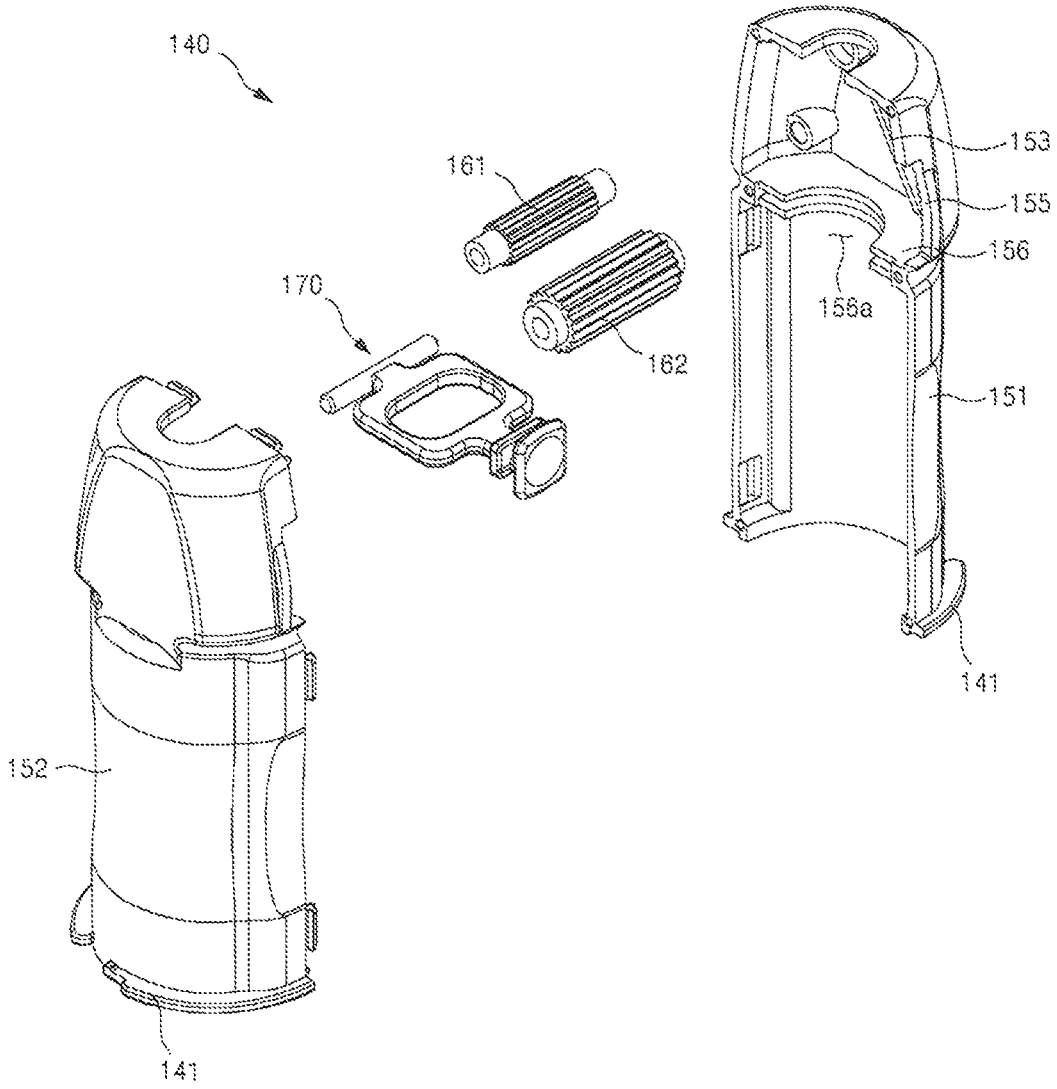
Figure 9:
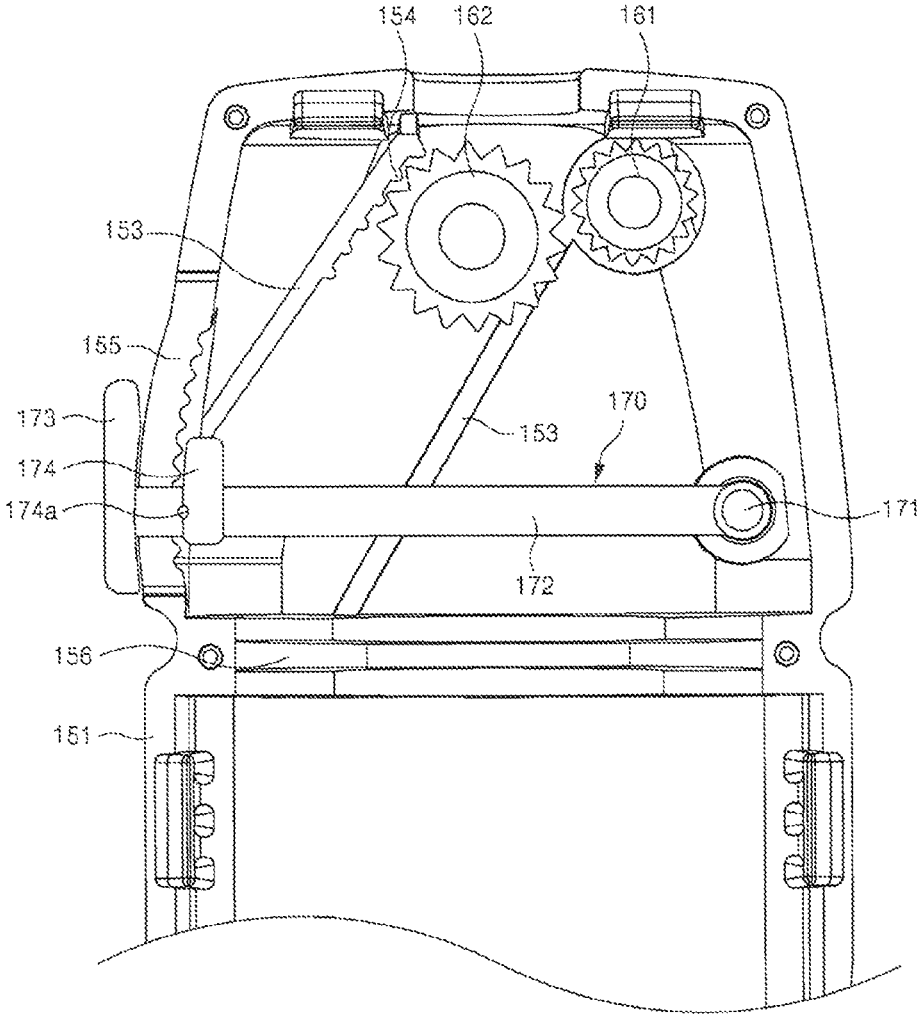
FIG. 9 is a front view showing the subject matter of the second module.
Figure 10:
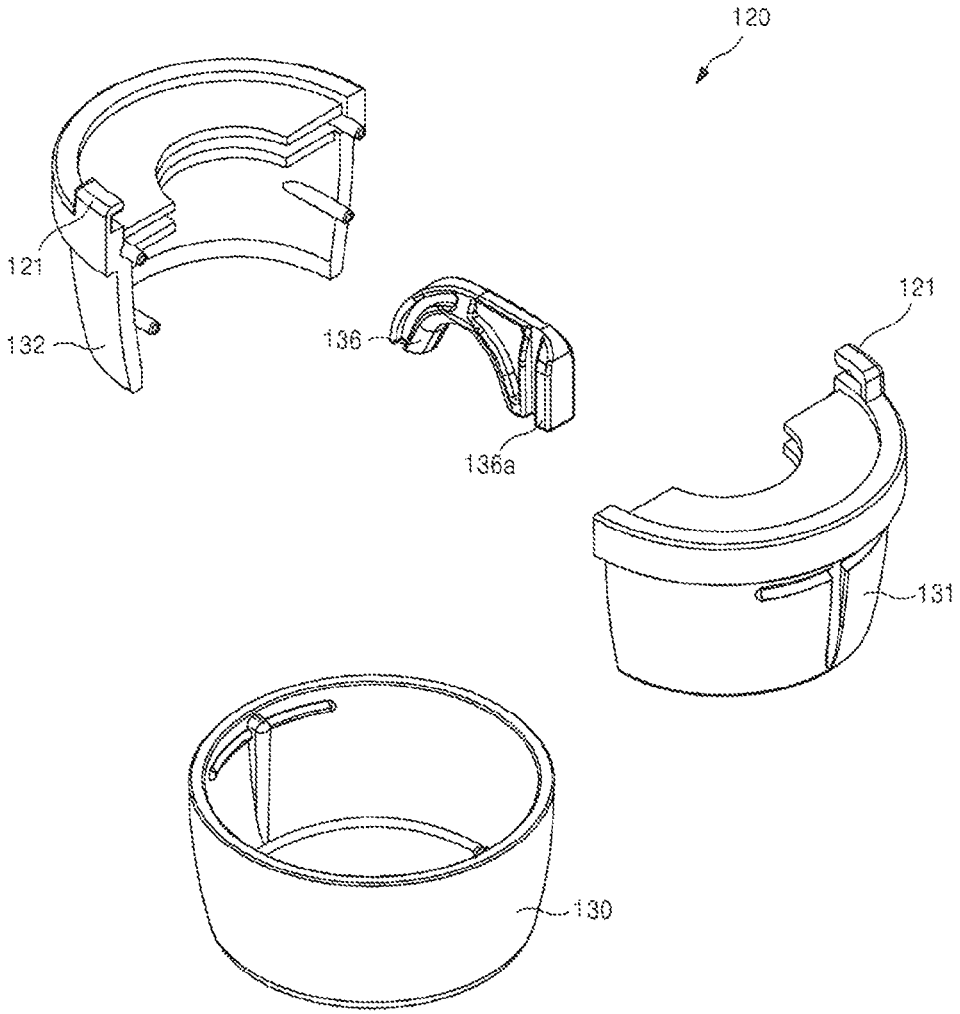
FIGS. 10 and 11 are exploded perspective views showing a first module at various angles.
Figure 11:
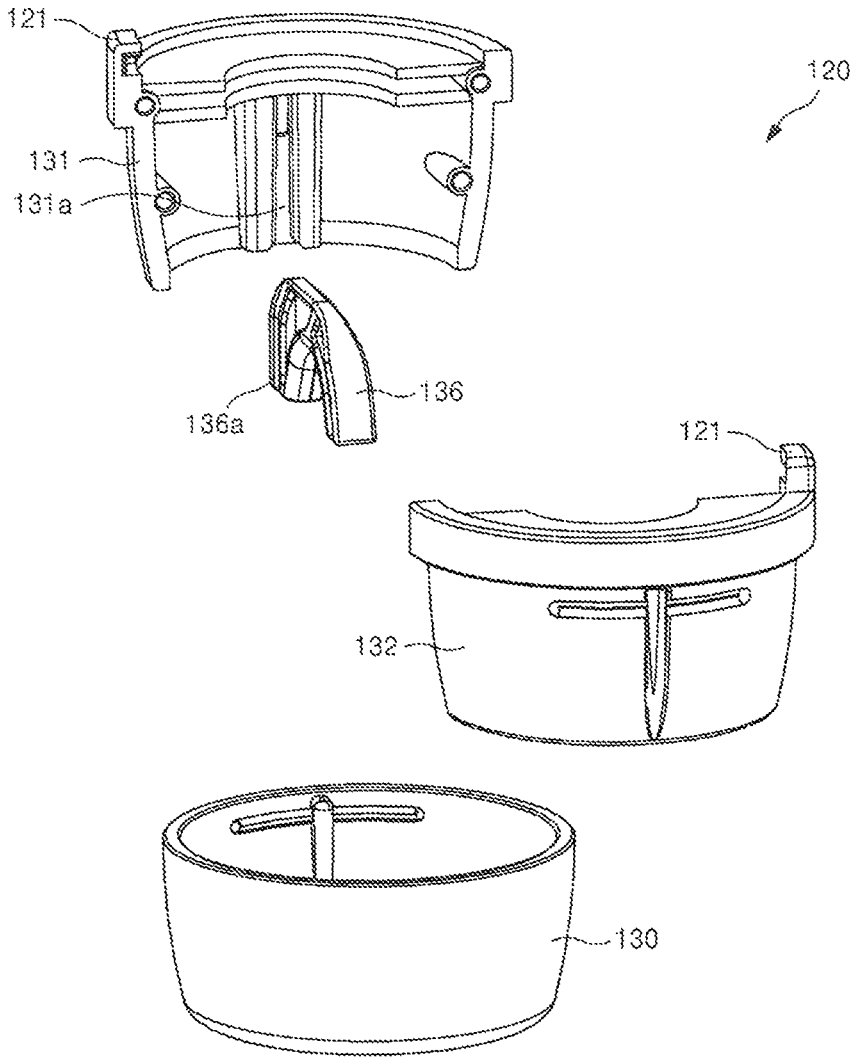

FIG. 1 is a front view showing a protection device for a blind string according to one embodiment of the present invention before the protection device is operated. FIG. 2 is a front view showing the protection device of FIG. 1 after the protection device has been operated. FIG. 3 is a view showing the structure of a bellows tube. FIG. 4 is a perspective view showing the protection device for the blind string. FIGS. 5 to 8 are exploded perspective views showing a second module at various angles. FIG. 9 is a front view showing the subject matter of the second module. FIGS. 10 and 11 are exploded perspective views showing a first module at various angles.

Referring to the above drawings, a protection device for a blind string according to the present invention can safely protect children from a blind string L so that the children are not in an accident caused by the blind string L, and can be operated in a compact and effective structure, so that the convenience for the use of the protection device can be increased. The protection device for the blind string according to the present invention includes a bellows tube 110, a first module 120, and a second module 140.

Hereinafter, effects made by a protection device for a blind string L according to the present embodiment will be described in detail.

In the state that the protection device for the blind string L is mounted on the blind string L as shown in FIG. 1, the second module 140 is moved up from the first module 120 and clamped on the blind string L at a position in which the second module 140 is moved up as shown in FIG. 2. In this case, a bellows tube 110 is spread to cover the blind string L.

As shown in FIG. 2, only the bellows tube 110, the first module 120, and the second module 140 are viewed from the outside, and the blind string L is covered by the bellows tube 110 so that the blind string L is not viewed.

Therefore, a phenomenon in which children play with the blind string L and are in an accident caused by the blind string L can be previously prevented.

The structure of the protection device for the blind string L according to the present embodiment, which can make the above effect, that is, the structure of the bellows tube 110, the first module 120, and the second module 140 will be sequentially described below.

The bellows tube 110 is provided in a tubular structure. The bellows tube 110 may be made of a synthetic resin material in a tubular structure allowing the blind string L to pass through the inner part thereof and having a length increased or reduced in a longitudinal direction of the blind string L.

In other words, the bellows tube 110 is provided in a tubular structure allowing the blind string L to pass through the inner part of the bellows tube 110 and a length increased (see FIG. 2) or reduced (see FIG. 1) in the longitudinal direction of the blind string L.

In other words, if the second module 140 shown in FIG. 1 is moved up as shown in FIG. 2, the bellows tube 110 cooperating with the second module 140 extends to cover the blind string L.

In this case, the bellows tube 110 is automatically spread due to the elasticity of the bellows tube 110. In other words, when the second module 140 is moved up from the first module 120, the bellows tube 110 has a difference in the thickness of the skin thereof as shown in FIG. 3 so that the bellows tube 110 can be automatically spread due to the elasticity of the bellows tube 110. In other words, the bellows tube 110 includes a hard material having elasticity, and has a difference in the thickness of the skin thereof.

The bellows tube 110 may include materials such as LDPE and EVA. The materials are mixed with each other ranging from the ratio of 9:1 to the ratio of 1:9 to manufacture the bellows tube 110, so that the spread rate of the bellows tube 110 caused by the elasticity thereof may be varied.

In the case that the bellows tube 110 has the difference in the thickness of the skin thereof as described above, if the second module 140 shown in FIG. 1 is decoupled from the first module 120 and moved up from the first module 120 as shown in FIG. 2, since the folded bellows tube 110 is spread due to the elasticity thereof, the second module 140 may be automatically moved up.

For reference, the blind string L described according to the present embodiment includes a beaded string. However, a string without beads may also be applied to the blind string L.

Next, the first module 120 is coupled with a lower end portion of the bellows tube 110, and an end portion of the blind string L is locked to an inner part of the first module 120. In other words, the first module 120 is constantly maintained at the original position thereof in the state that the first module 120 is locked to a lower end portion of the blind string L.

In order to lock the first module 120 to the blind string L, the first module 120 must be disassembled and then assembled.

The structure of the first module 120 will be described with reference to FIGS. 10 and 11.

According to the present embodiment, the first module 120 includes an outer cap 130 for a lower module, inner caps 131 and 132 for first and second lower modules, which are partially inserted into the outer cap 130 for the lower module, prepared separately from each other, and detachably coupled with each other, and a string locking member 136 detachably coupled with the inner cap 131 for the first lower module so that the blind string L is locked to the string locking member 136.

In this case, the first inner cap 131 for the first lower module is provided in an inner wall thereof with a rail coupling groove 131*a* with which a rail block 136*a* of the string locking member 136 is slidably coupled.

Accordingly, in the state that all of the outer cap 130 for the lower module, the inner caps 131 and 132 for the first and second lower modules, and the string locking member 136 are disassembled, the lower end portion of the blind string L is locked to the string locking member 136 while the string locking member 136 is coupled with the inner cap 131 for the first lower module. Subsequently, the inner caps 131 and 132 for the first and second lower modules are assembled with each other, and the assembly is inserted into the outer cap 130 for the lower module and coupled with the outer cap 130 for the lower module, so that the blind string L can be easily coupled with the first module 120.

Finally, as shown in FIGS. 1 and 2, the second module 140 is detachably coupled with an upper portion of the first module 120 while the bellows tube 110 is interposed between the second module 140 and the first module 120 so that the bellows tube 110 can be folded.

Since the first module 120 must not be voluntarily decoupled from the second module 140 when the protection device is in a locking state, as shown in FIG. 1, a locking hook 121 is provided at one of the first and second modules 120 and 140, and a locking step 141 is provided at the other of the first and second modules 120 and 140.

According to the present embodiment, the locking hook 121 is provided at the first module 120, and the locking step 141 is provided at the second module 140.

However, an inverse case is sufficiently possible. In other words, the locking hook 121 may be provided at the second module 140, and the locking step 141 may be provided at the first module 120.

Therefore, when the second module 140 is moved up from the state of FIG. 1 as shown in FIG. 2, the locking state between the locking hook 121 and the locking step 141 provided at the first module 120 and the second module 140, respectively, may be unlocked. In this case, since the folded bellows tube 110 is expanded and spread due to the elasticity thereof, the second module 140 may be automatically moved up.

The second module 140 includes first and second housings 151 and 152, a fixed gear 161, a movable gear 162, and a lever 170.

The first and second housings 151 and 152 form a space through which the blind string L passes. The first and second housings 151 and 152 are structures detachably coupled with each other.

The first and second housings 151 and 152 are provided at an upper portion thereof with a through hole H (see FIG. 4) through which the blind string L passes.

The first and second housings 151 and 152 are provided on inner walls thereof with a partition 156 having therein an opening 156*a* through which the blind string L passes. The first and second housings 151 and 152 may be prevented from being deformed by the partition 156.

For reference, the coupling structure between the first and second housings 151 and 152 may be a hook-type coupling structure similar to the coupling structure between the inner caps 131 and 132 for the first and second lower modules. However, a bolt-type coupling structure may be applied to the coupling structure between the first and second housings 151 and 152 instead of the hook-type coupling structure.

Both end portions of the fixed gear 161 are rotatably coupled with the inner walls of the first and second housings 151 and 152. The fixed gear 161 is freely rotated at the position thereof except that the position of the fixed gear 161 is not changed.

The movable gear 162 is arranged adjacent to the fixed gear 161 while the blind string L is interposed between the movable gear 162 and the fixed gear 161.

According to the present embodiment, the movable gear 162 has a diameter greater than that of the fixed gear 161. However, since the movable gear 162 may not have the diameter greater than that of the fixed gear 161, the scope of the present invention is not limited to the shapes shown in accompanying drawings.

Different from the fixed gear 161, the movable gear 162 may approach the fixed gear 161 or may be spaced apart from the fixed gear 161. In other words, the movable gear 162 is rotatable, and may approach the fixed gear 161 or may be spaced apart from the fixed gear 161.

To this end, the first and second housings 151 and 152 are provided on the inner walls thereof with movement guide walls 153 to guide the position change of the movable gear 162. A pair of movement guide walls 153 are spaced apart from each other while interposing the movable gear 162 therebetween.

In addition, the first and second housings 151 and 152 are provided on the inner walls thereof with rotation guide tooth parts 154 to guide the rotation of the movable gear 162. The rotation guide tooth part 154 may be formed integrally with one of the movement guide walls 153.

The lever 170 is a structure having one side provided in the first and second housings 151 and 152 and an opposite side out of the first and second housings 151 and 152 to manipulate the movable gear 162.

In other words, the lever 170 allows the movable gear 162 to approach the fixed gear 161 so that the blind string L is clamped between the fixed gear 161 and the movable gear 162. In other words, if the lever 170 is pushed up in the state that the second module 140 is moved up from the state of FIG. 1 as shown in FIG. 2, the movable gear 162 is moved to the fixed gear 161 so that the blind string L is clamped between the movable gear 162 and the fixed gear 161, thereby preventing the second module 140 from being arbitrarily moved down.

The lever 170 to perform the above function includes a hinge 171 coupled with the first and second housings 151 and 152, a gear pressing plate 172 coupled with the hinge 171, having an opening 172*a*, through which the blind string L passes, and pressing the movable gear 162, and a manipulation part 173 coupled with the gear pressing plate 172 and provided outside the first and second housings 151 and 152.

Meanwhile, a waveform step part 155 is formed in the first and second housings 151 and 152 corresponding to the position of the manipulation part 173 to guide the position change of the manipulation part 173 step by step. The manipulation part 173 of the lever 170 is additionally coupled with a protrusion plate 174 having a protrusion part 174*a* locked to the waveform step part 155.

Hereinafter, the operation of the protection device for the blind string will be described.

First, the protection device for the blind string L is mounted on the blind string L. That is to say, in the state that all of the outer cap 130 for the lower module, the inner caps 131 and 132 for the first and second lower modules, and the string locking member 136 are disassembled from each other, the lower end portion of the blind string L is locked to the string locking member 136 while the string locking member 136 is coupled with the inner cap 131 for the first lower module.

Next, the inner caps 131 and 132 for the first and second lower modules are assembled with each other, inserted into the outer cap 130 for the lower module, and coupled with the outer cap 130 for the lower module, so that the blind string L is coupled with the first module 120.

Similarly, the first and second housings 151 and 152 are disassembled and assembled while the blind string L is interposed between the first and second housings 151 and 152, so that the blind string L is installed in the second module 140, and the second module 140 is coupled with the first module 120, thereby installing the protection device for the blind string.

After the protection device for the blind string has been completely finished, the second module 140 is moved up from the state of FIG. 1 as shown in FIG. 2.

In this case, only the release of the locking state between the locking hook 121 and the locking step 141 provided in the first and second modules 120 and 140, respectively, is required.

Then, since the folded bellows tube 110 is expanded and spread due to the intrinsic elasticity thereof as shown in FIG. 2, the second module 140 may be automatically moved up (in the direction of A).

In other words, since the bellows tube 110 has predetermined elasticity to perform self-movement, the second module 140 is moved up (in the direction of A) due to the self-movement of the bellows tube 110. In this state, if the second module 140 is further moved up, the first module 120 is moved up together with the second module 140, so that the blind string L can be completely hidden in the bellows tube 110.

In this state, the manipulation part 173 of the lever 170 is pushed up by a hand of a user in the state that the blind string L is completely hidden in the bellows tube 110.

If the manipulation part 173 of the lever 170 is pushed up by the hand of the user, the movable gear 162 is moved to the fixed gear 161 by the pushing force, so that the blind string L may be clamped between the movable gear 162 and the fixed gear 161, thereby preventing the second module 140 from being arbitrarily moved down due to the above operation.

If the manipulation has been completed as shown in FIG. 2, only the bellows tube 110, the first module 120, and the second module 140 are viewed, and the blind string L is hidden in the bellows tube 110, so that the blind string L is not viewed.

Therefore, a phenomenon in which children play with the blind string L and are in an accident caused by the blind string L can be previously prevented.

As described above, according to the present embodiment, children can be protected from the blind string L so that an accident does not occur to the children due to the blind string L.

In particular, the protection device according to the present embodiment can be easily manipulated. Most of all, the present product can be installed on the blind string L without the replacement of the entire portion of an existing blind, so that the protection device can be conveniently installed.

Although an exemplary embodiment of the present invention has been described for illustrative purposes, those skilled in the art will appreciate that various modifications, additions and substitutions are possible, without departing from the scope and spirit of the invention as disclosed in the accompanying claims. In addition to variations and modifications in the component parts and/or arrangements, alternative uses will also be apparent to those skilled in the art.

What is claimed is:

1. A protection device for a blind string, comprising:

a first module having a first inner space and a locking hook which is disposed at one end of the first module;

a second module having a second inner space and a locking step which is disposed at one end of the second module, wherein the locking hook is interlocked with the locking step when the protection device is in a locking state; and a bellows tube formed of a tubular structure and interposed between the first and the second modules, wherein the bellows allows the blind string to pass through an inner space of the bellows tube, and has a length capable of increasing and decreasing due to elasticity in a longitudinal direction of the blind string, wherein one end of the bellows tube is coupled to the first module and an opposite end of the bellows tube is coupled to the second module, wherein when the protection device is in the locking state, the bellows tube is collapsed such that it is entirely contained within the first and second inner spaces and not outwardly visible, and wherein the bellows tube is expanded so that the bellows tube is exposed outwardly when the protection device is in an unlocking state.

2. The protection device of claim 1, wherein the first module comprises:

an outer cap for a lower part of the first module;

inner caps, said inner caps being attached together, wherein the attached inner caps include a string locking member and are partially inserted into the outer cap, wherein the string locking member is detachably coupled with the attached inner caps such that an end portion of the blind string is locked to the string locking member.

3. The protection device of claim 2, wherein an inner wall of at least one of the inner caps of the first module is provided with a rail coupling groove with which a rail block of the string locking member is slidably coupled.

4. The protection device of claim 1, wherein the second module comprises:

first and second housings to form the second inner space through which the blind string passes, said first and second housings being detachably coupled with each other;

a fixed gear, wherein ends of the fixed gear are rotatably coupled with inner walls of the first and second housings;

a movable gear arranged adjacent to the fixed gear such that the blind string is interposed between the movable gear and the fixed gear; and a lever, one end of the lever disposed in the first and second housings and the other end of the lever exposed outside of the first and second housings and allowing the movable gear to approach the fixed gear so that the blind string is clamped between the fixed gear and the movable gear.

5. The protection device of claim 4, further comprising movement guide walls provided at the inner walls of the first and second housings to guide a position change of the movable gear.

6. The protection device of claim 4, further comprising rotation guide tooth parts provided at the inner walls of the first and second housings to guide rotation of the movable gear.

7. The protection device of claim 4, wherein the lever comprises:

a hinge coupled with the first and second housings;

a gear pressing plate coupled with the hinge, pressing the movable gear; and a manipulation part coupled with the gear pressing plate and provided outside the first and second housings.

8. The protection device of claim 7, further comprising a waveform step part formed in the first and second housings corresponding to a position of the manipulation part to guide a position change of the manipulation part step by step, wherein the manipulation part is additionally coupled with a protrusion plate having a protrusion part locked to the waveform step part.

9. The protection device of claim 4, wherein the movable gear has a diameter greater than a diameter of the fixed gear.

10. The protection device of claim 4, further comprising a partition formed at the inner walls of the first and second housings and having an opening through which the blind string passes.

11. The protection device of claim 1, wherein the blind string is a string or a beaded string, and is substantially contained within the bellows tube and not visible outside when the bellows tube is spread due to elasticity so that the second module is moved up from the first module.

* * * * *